US005841944A

United States Patent [19]

Hutchinson et al.

[11] Patent Number: 5,841,944

[45] Date of Patent: Nov. 24, 1998

[54] INFANT WARMER RADIANT HEATER HEAD

[75] Inventors: Christopher Peter Hutchinson; Richard Geoffrey Templer; David James Keeley, all of Auckland, New Zealand

[73] Assignee: Fisher & Paykel Limited, Auckland, New Zealand

[21] Appl. No.: 680,241

[22] Filed: Jul. 11, 1996

[30] Foreign Application Priority Data

Jul. 14, 1995 [NZ] New Zealand ..... 272577

[51] Int. Cl.[6] ..... F26B 3/30

[52] U.S. Cl. ..... 392/418; 392/422; 392/426; 362/296; 219/218

[58] Field of Search ..... 392/422, 423, 392/424, 425, 426, 427, 428, 429, 430, 431, 418; 362/296, 294

[56] References Cited

U.S. PATENT DOCUMENTS

| | | | |
|---|---|---|---|
| 3,766,357 | 10/1973 | Koester | 219/300 |
| 3,944,807 | 3/1976 | Fratti | 392/422 |
| 4,186,294 | 1/1980 | Bender | 219/527 |
| 4,809,677 | 3/1989 | Mackin | 392/413 |
| 5,162,038 | 11/1992 | Wilker | 219/497 |
| 5,376,761 | 12/1994 | Koch et al. | 177/145 |

FOREIGN PATENT DOCUMENTS

| | | | |
|---|---|---|---|
| 62-108928 | 5/1987 | Japan | 392/422 |
| 1094 | 10/1964 | United Kingdom | 392/423 |

*Primary Examiner*—Teresa J. Walberg
*Assistant Examiner*—Quan Nguyen
*Attorney, Agent, or Firm*—Trexler, Bushnell, Giangiorgi & Blackstone, Ltd.

[57] ABSTRACT

An infrared radiant heater for use in an infant warmer open care bed. The heater includes a curved reflector within a similarly shaped housing. Between the reflector and casing is at least one baffle made of a heat insulating material. The baffle divides the inside of the housing into a number of separate insulating air gaps. In order to ensure that heat is not conducted through the head, spacers protrude from the housing to support the baffles at their required positions maintaining heat insulating air gaps between the heater head components.

8 Claims, 4 Drawing Sheets

INFANT WARMER RADIANT HEATER HEAD

FIELD OF THE INVENTION

This invention relates to radiant heaters and more particularly though not solely to Infrared radiant heater heads for use in infant warmer open care beds for providing temperature regulation of infants in maternity and newborn care facilities.

DESCRIPTION OF THE PRIOR ART

In order to direct heat and/or light from a radiant source to an area where the heat or light is required, reflectors are often used in close proximity to the source. The shape of the reflector used in conjunction with a radiant heater is often parabolic in cross-section with the heat source being positioned at the focal point of the reflector in an attempt to produce parallel rays of reflected radiation so that the spatial pattern of heat distribution from the source to a target area is uniform. In order to protect a user from contacting the radiant heater, the heater and reflector are cased in a housing unit.

Many prior infant warmers use radiant heater housing units (or heater head units) which are made of metal in order to withstand high temperatures. Examples of prior infant warmers utilising radiant heaters to warm infants are disclosed in U.S. Pat. No. 5,162,038 to Hill-Rom Company, U.S. Pat. No. 4,809,677 to The BOC Group and U.S. Pat. No. 5,376,761 issued to Ohmeda Inc. The prior heater units used in infant warmers have been large in order to dissipate more heat and usually include holes or vents in their upper surface in order to remove heated air from within the heater head unit. The holes allow hot air to flow from inside the unit to outside the unit causing a rise in temperature of the outer surface of the heater head, further necessitating the use of metal in the heater unit's construction. This heat loss lowers the energy efficiency of the heater. It would be an advantage to construct a heater unit for an infant warmer from a less expensive material such as plastic which could be injection moulded.

It is, therefore, an object of the present invention to produce a radiant heater head, which will go at least some way towards overcoming the above disadvantages or which will at least provide the public with a usefull choice.

BRIEF SUMMARY OF THE INVENTION

Accordingly, in one aspect, the invention consists in a radiant heater comprising:

curved reflector means having an inner reflecting surface, an outer surface and an open side, an outer casing means provided adjacent said outer surface of said curved reflector means, there being an enclosed space formed between said outer casing means and said curved reflector means, said outer casing having an internal surface facing said curved reflector means, radiant energy source means positioned adjacent to said inner reflecting surface, insulating sheath means located in said enclosed space formed between said outer casing means and said curved reflector means, said insulating sheath means being offset from said shaped reflector means, dividing said enclosed space into a number of insulating pocket regions adapted to be filled with stagnant gases.

In a further aspect the invention consists in an infant warmer comprising:

base means, support column means having a lower end mounted on said base means, infant support means connected to said support column at a predetermined distance from said lower end, and a radiant heater as set out in the above paragraph connected to said support column at a distance from said lower end greater than said predetermined distance with said open side directed towards said infant support means.

BRIEF DESCRIPTION OF THE DRAWINGS

The invention consists in the foregoing and also envisages constructions of which the following gives examples.

One preferred example of the invention will now be described with reference to the accompanying drawings in which.

DETAILED DESCRIPTION OF THE INVENTION

Figure 1:
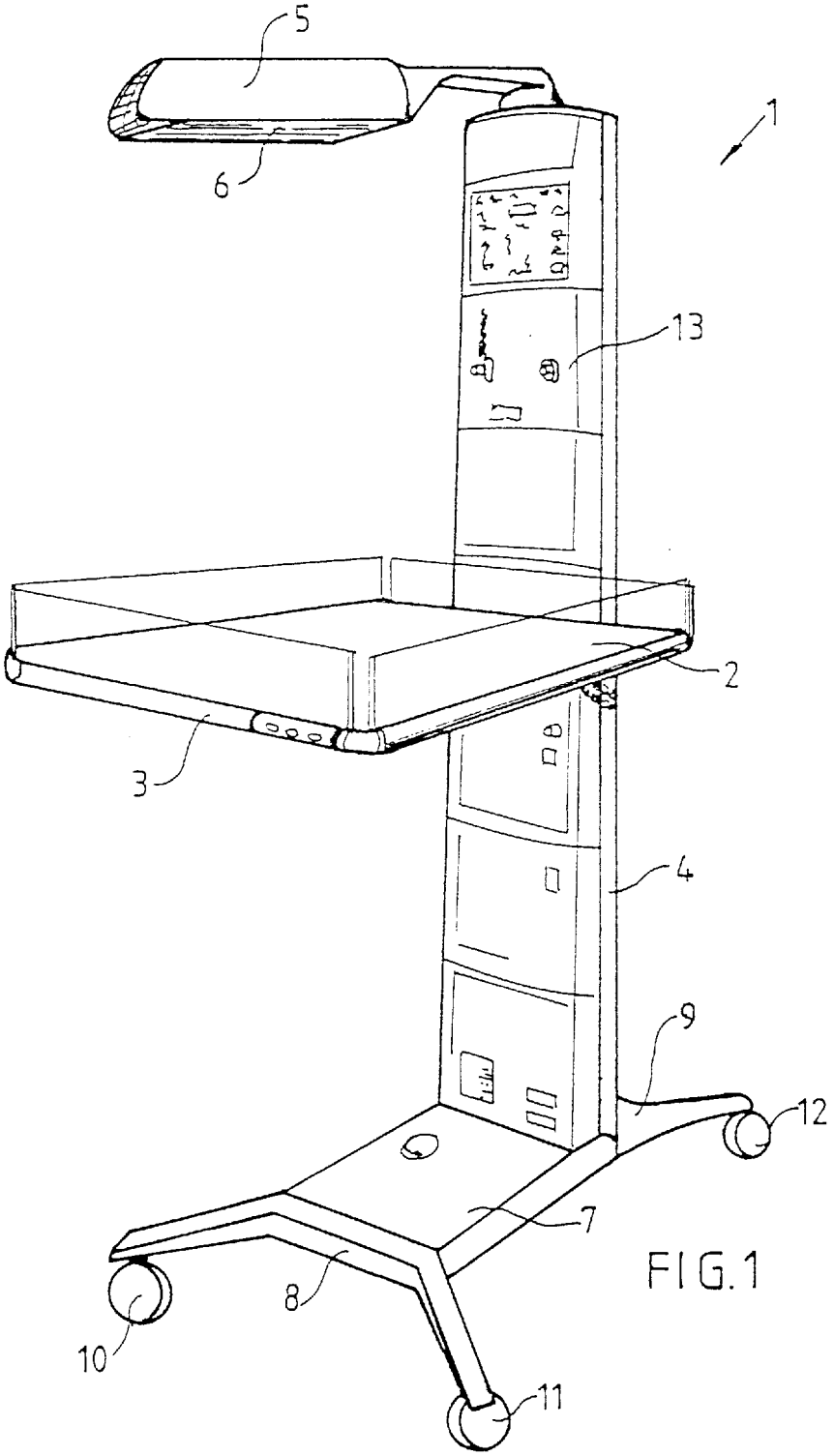
FIG. 1 is a perspective view of an infant warmer having a radiant heater head constructed according to the present invention.

With reference to the drawings, FIG. 1 shows an infant warmer open care bed (warmer) generally referenced 1 which is used in maternity and newborn care facilities to allow medical personnel to attend an infant or baby while maintaining the infant or baby at a desired temperature. The warmer 1 has a mattress 2 for an infant to lie on which is supported on an adjustable table 3 connected to a substantially vertical modular support column 4. Also connected to modular support column 4 is a warmer heater head unit 5 constructed according to one preferred form of the present invention having an open region 6 directed towards the mattress 2. The base of the modular support column 4 is connected to a base unit 7 having substantially "U" shaped stand elements 8 and 9 pivotally projecting there from. Castors 10, 11 and 12 (a fourth castor is hidden from view) are provided at the ends of each "leg" of "U" shaped stand elements 8 and 9. The height of warmer 1 (and accordingly the height of the mattress 2) may be adjusted by pivoting "U" shaped stand elements about their connection with base unit 7.

Figure 2:
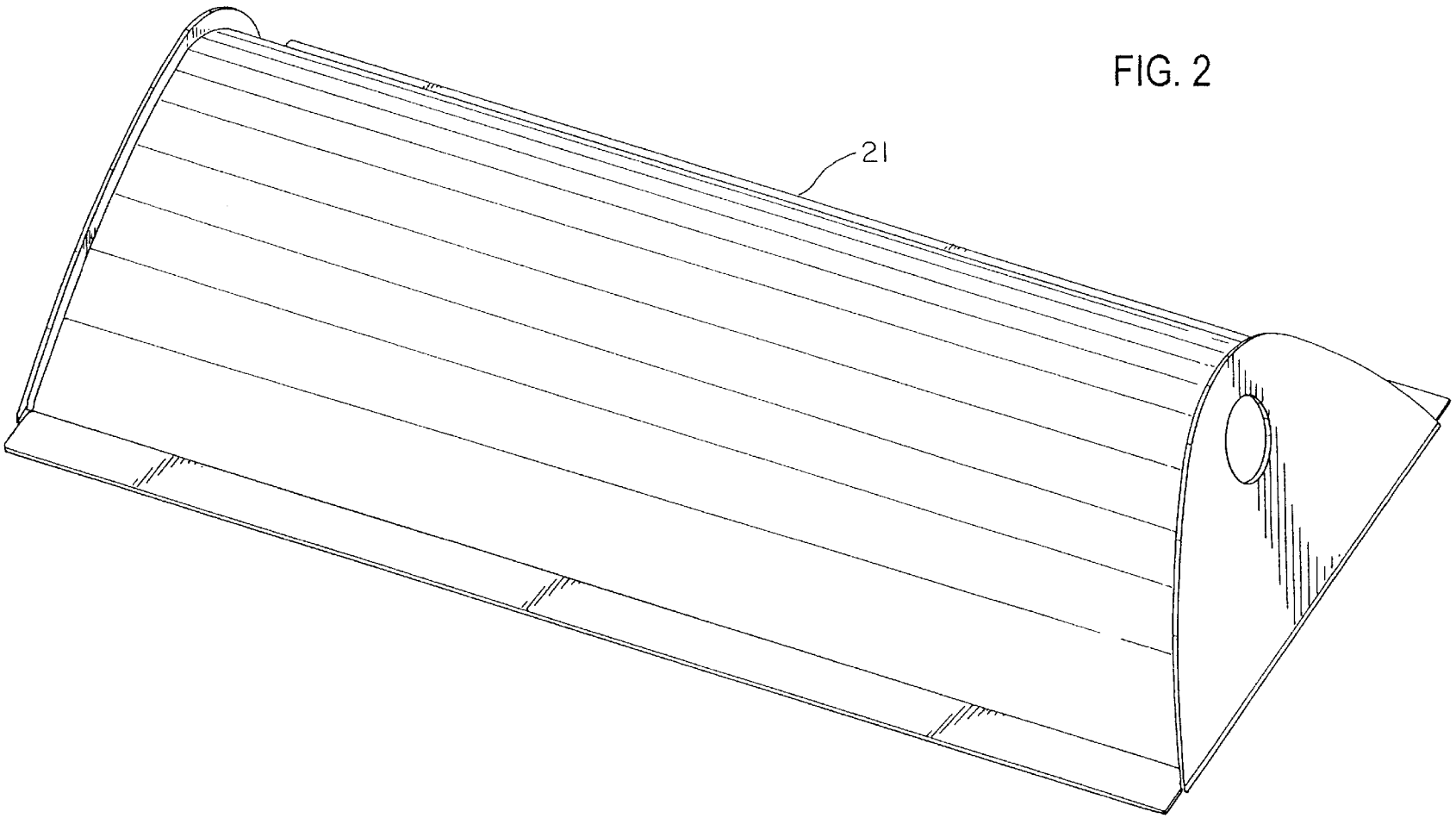
FIG. 2 is a "wire frame" isometric view of a reflector produced in accordance with the present invention for use in the radiant heater head shown in FIG. 1.
Figure 3:
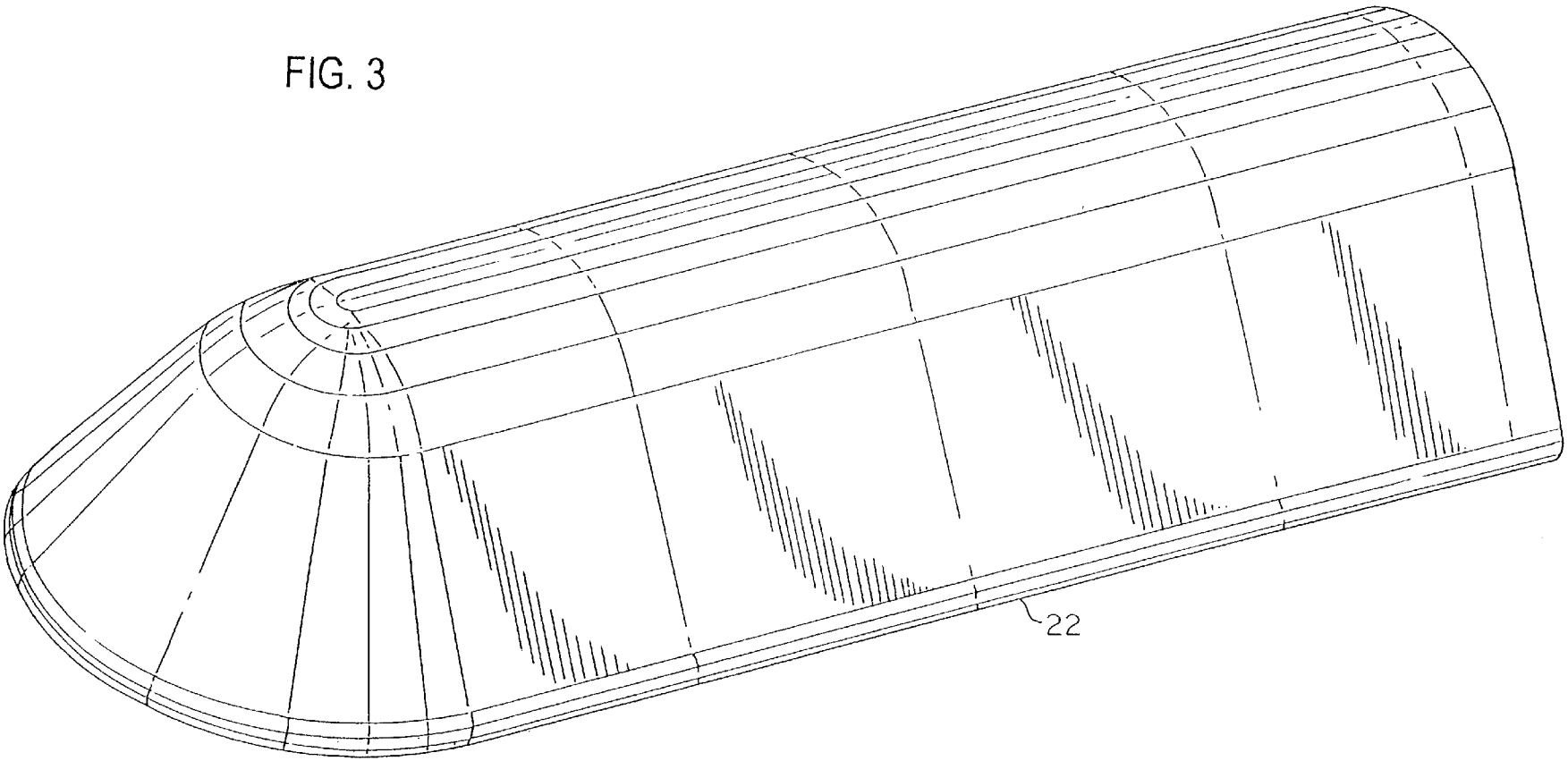
FIG. 3 is a "wire frame" isometric view of a radiant heater head outer casing for use in the radiant heater head shown in FIG. 1.
Figure 4:
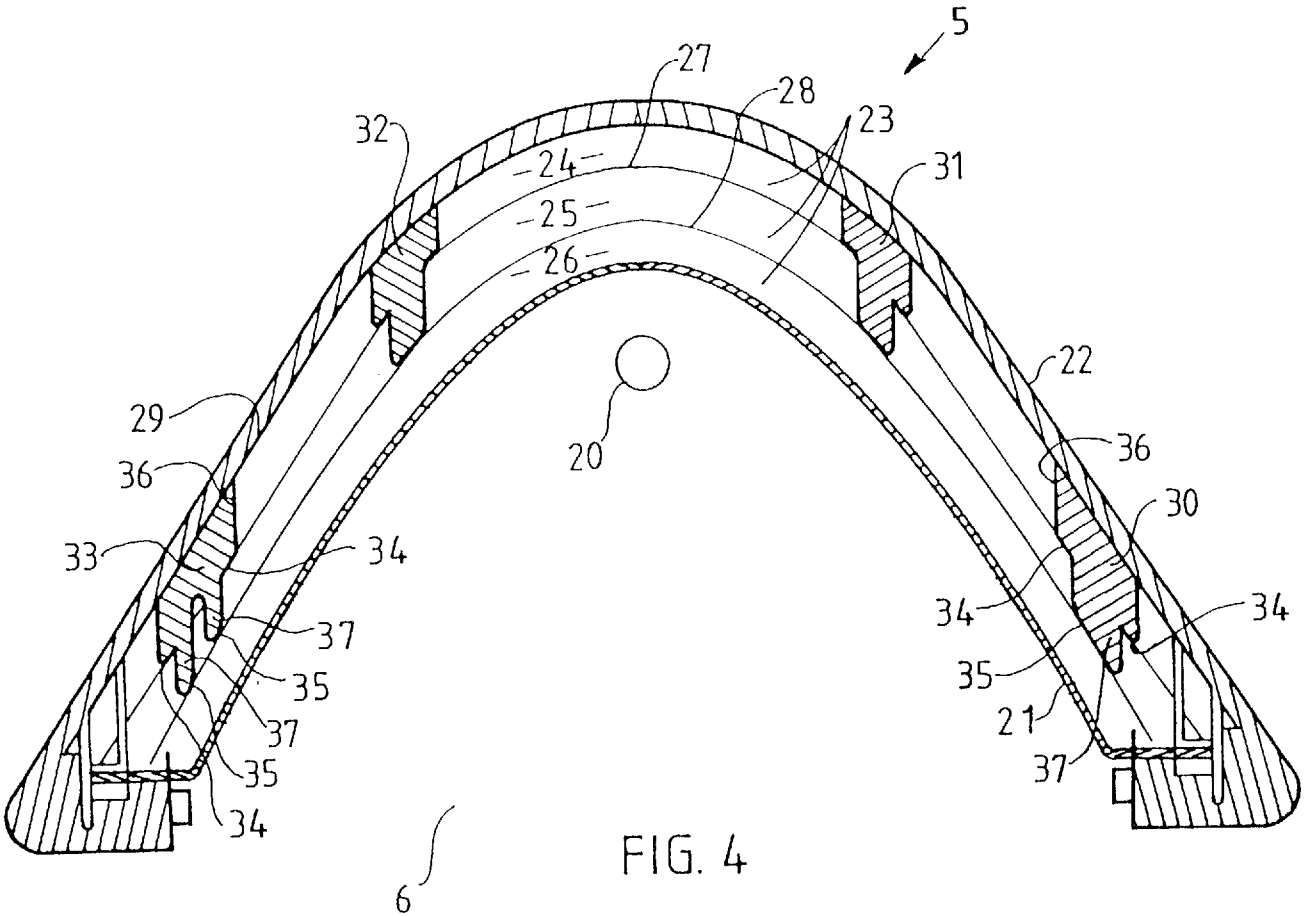
FIG. 4 is a cross-sectional view of the radiant heater head shown in FIG. 1.

With reference to FIG. 4, the warmer head 5 has a layered construction with an outer casing 22, preferably injection moulded from a hard plastics material with good insulation and heat deflection properties such as that sold under the trade mark APEC by Bayer Plastics (see also FIG. 3). A source of radiant energy, preferably a heater element 20 is positioned within heater head 5 which is preferably an 8 mm diameter infrared bar element manufactured by TruHeat which runs along the length of the warmer head 5. Heater element 20 preferably comprises an outer tube of metal material such as that sold under the trade marks INCOLOY or INCANEL containing a co-axial resistive heating element wire surrounded with magnesium oxide packing. Except for the ends of the heater and open region 6, a reflector 21 substantially surrounds the element 20 so that radiant energy in the form of heat produced by heater element 20 either travels out of open region 6 or interacts with the reflector 21 (see also FIG. 2). Preferably the reflector is pressed from a highly heat reflective material such as polished Aluminium.

Between reflector 21 and outer casing 22 is an air filled space 23 which is divided preferably into three insulating pocket regions 24, 25 and 26 by baffles 27 and 28. It should be noted that, although only two baffles are shown in FIG. 4, one baffle could be used (baffle 27) in which case there would be two insulating pocket regions, or alternatively, there could be more than two baffles between the reflector 21 and outer casing 22. Baffles 27 and 28 are preferably made from a thin and flexible heat insulating material such as that sold under the trade mark NOMEX which is an aramid paper. Each of the baffles 27 and 28 are preferably rectangular sheets of material bent into a similar shape to that of the reflector. It can be seen that the cross-sectional length of baffle 28 is slightly greater than that of reflector 21 in order to ensure that the baffle extends completely from one end of the reflector to the other "end" while an offset distance is maintained between the two. The same is true of the cross-sectional length of the two baffles 27 and 28 in order to achieve a separation or offset between them and between baffle 27 and outer casing 22. The separation of each of the heater head components ensures that the conduction paths for heat through the heater head 5 have high thermal resistance.

Most of the radiating energy travelling away from open region 6 is reflected by the reflector 21 towards the open region 6, however some heat will be conducted by the reflector which will eventually cause the reflector to rise in temperature allowing heat to be re-radiated, conducted and convected. In order to minimise the transfer of heat through the heater head 5, the aforementioned insulating pocket regions 24, 25 and 26 which are filled with stagnant gas, for example air, provide a good insulator against conducted and convected heat. In addition, the insulating properties of baffles 27 and 28 and outer casing 22 ensure that the external temperature of the outer casing 22 is significantly less than the surface temperature of the element 20 thereby reducing the risk of danger to medical personnel by way of burning.

In order to ensure that the aforementioned separation between the outer casing, baffles 27 and 28 and reflector 21 is maintained, the inner surface 29 of outer casing 22 is provided with projecting spacing means, preferably protruding spacers, for example 30, 31, 32 and 33 around its "circumference" with further spacers provided along the length of inner surface 29 of outer casing 22. Each of the spacers have (in the case of two baffles being provided) two supporting surfaces at different distances from the inner surface 29. With reference to spacer 30, a base part 36 provides a first support surface 34 at, for example, 7 mm from the inner surface 29. Projecting from first support surface 34 is a second extending part 37 of the two part spacer 30 which provides a second support surface 35 which may be, for example, at a distance of 14 mm from the inner surface 29. Preferably, each of the projecting spacing means are knife-like protrusions having a width of, for example, 1 mm or 2 mm. In an alternative to protruding spacers 30, 31 and 32 protruding spacer 33 is provided with two extending parts 37 from the first support surface 34 providing two second support surfaces 35 in close proximity.

It can be seen that baffle 28 is supported at a predetermined distance (for example 7 mm) from the reflector 21 by each of the second support surfaces which abut baffle 28 at predetermined positions along its length and around its circumference. In addition, baffle 27 is held at a separation of, for example, 7 mm from baffle 28. Baffle 27 is provided with small holes or slits positioned so that the second extending parts 37 of the protruding spacers may be passed through the slits with first support surfaces 34 supporting baffle 27 in the region surrounding the slits. Where more than two baffles are provided in space 23, separate support surfaces, spaced an appropriate distance from one another are provided for each baffle. When only one baffle is provided in air filled space 23, support surface 34 of each protruding spacer may be used to hold the baffle in position within the space 23.

The construction of the heater head which has been described may be differentiated from prior heating heads by the fact that the present invention attempts to trap or enclose a volume of air within the head while prior heads attempt to remove the heated air as quickly as possible. We have found that by trapping a volume of air, we are able to increase the insulating effect of the heater head and reduce the outer surface temperature of the unit, reducing the risk of burning to medical personnel or other operators of the warmer.

A control means 13 comprising one of a number of modules positioned in modular support column 4 is supplied with electrical power by a mains voltage connector (not shown) and is also connected to receive input data from various sensors associated with the warmer and to control various functions of the warmer via a series of outputs. The control means, for example, may comprise a microprocessor with associated logic hardware, analogue to digital converter and memory components. A software program, stored in memory associated with the microprocessor may be executed by the microprocessor to carry out the various input/output functions required of the warmer. One sensor connected to the control means 13 is a temperature sensor (for example a thermistor) which is connected to the infant's body to produce a signal indicative of the infant's body temperature to control means 13. During the execution of the aforementioned software program, an output signal is produced which is used to control the state of heater element 20 within warmer head 5. For example, if the temperature of the infant's body is sensed to be below a desired value which has been preset or manually entered into the software program executed by the microprocessor of control means 13, then the microprocessor will issue a signal to the heater element or to a heater element control circuit) to request that the heater switch on or alternatively increase its power output. When the temperature of the infant is found to meet the preset or manually entered desired temperature then the microprocessor issues a signal to turn off heater element 20 or alternatively to reduce the output power of the heater element.

Thus the present invention provides an improved efficiency heater head for a radiant energy source in which the energy produced by heater element 20 is not wasted by being absorbed through the heater head and then dispersed to the surroundings but is forced to travel in a desired direction where the energy will be used beneficially. Due to the trapping of air within the heater head, the temperature of the casing exposed to medical personnel is reduced compared to other heater heads. In comparison to existing heater heads, it is anticipated that, in order to achieve the same level of power at the mattress, a heater head constructed according to the present invention will require a much lower power heater element due to its improved efficiency. In addition, the layered or "sandwich" construction previously described allows the total volume of the constructed heater head to be reduced resulting in a saving of materials and cost.

We claim:

1. A radiant heater comprising:

curved reflector means having an inner reflecting surface, an outer surface and an open side, an outer casing means provided adjacent said outer surface of said curved reflector means, there being an enclosed space containing stagnant gases formed between said outer casing means and said curved reflector means, said outer casing means having an internal surface facing said curved reflector means, radiant energy source means positioned adjacent to said inner reflecting surface, insulating means located in said enclosed space formed between said outer casing means and said curved reflector means, said insulating means being offset from said curved reflector means, dividing said enclosed space into a number of insulating pocket regions which each substantially enclose some of said stagnant gases.

2. A radiant heater as claimed in claim 1 wherein a plurality of projecting spacing means are provided on said internal surface of said outer casing means which extend into said enclosed space, said projecting spacing means extending from said internal surface of said outer casing means and providing support for said insulating means to ensure that said offset between said insulating means and said curved reflector means is maintained to provide a high thermal resistance path to energy radiated by said radiant energy source means which does not travel through said open side of said curved reflector means.

3. A radiant heater as claimed in claim 1 or claim 2 in which said insulating means comprise at least two baffles, a first baffle provided between said reflector and said outer casing means, and a second baffle provided between said first baffle and said reflector.

4. A radiant heater as claimed in claim 3 where said first baffle is provided with a number of holes therein spaced at predetermined positions aligned with said plurality of projecting spacing means and said projecting spacing means each comprise a two part spacing protrusion, a first part of each said projecting spacing means extending from said internal surface of said outer casing means and providing at least one first support surface for said first baffle to abut and a second part of said projecting spacing means extending beyond said first support surface, said second part of said projecting spacing means adapted to protrude through said holes provided in said first baffle and providing at least one second support surface to abut said second baffle means.

5. An infant warmer comprising:

base means, support column means having a lower end mounted on said base means, infant support means connected to said support column at a predetermined distance from said lower end, and a radiant heater comprising: curved reflector means having an inner reflecting surface, an outer surface and an open side, an outer casing means provided adjacent said outer surface of said curved reflector means, there being an enclosed space containing stagnant gases formed between said outer casing means and said curved reflector means, said outer casing means having an internal surface facing said curved reflector means, radiant energy source means positioned adjacent to said inner reflecting surface, insulating means located in said enclosed space formed between said outer casing means and said curved reflector means, said insulating means being offset from said curved reflector means, dividing said enclosed space into a number of insulating pocket regions which each substantially enclose some of said stagnant gases, said radiant heater being connected to said support column at a distance from said lower end greater than said predetermined distance with said open side directed towards said infant support means.

6. An infant warmer as claimed in claim 5 wherein a plurality of projecting spacing means are provided on said internal surface of said outer casing means which extend into said enclosed space, said projecting spacing means extending from said internal surface of said outer casing means and providing support for said insulating means to ensure that said offset between said insulating means and said curved reflector means is maintained to provide a high thermal resistance path to energy radiated by said radiant energy source means which does not travel through said open side of said curved reflector means.

7. An infant warmer as claimed in claim 5 or claim 6 in which said insulating means comprise at least one baffle, a first of said at least one baffle provided between said reflector and said outer casing means, and a second baffle provided between said first baffle and said reflector.

8. An infant warmer as claimed in claim 7 where said first baffle is provided with a number of holes therein spaced at predetermined positions aligned with said plurality of projecting spacing means and said projecting spacing means each comprise a two part spacing protrusion, a first part of each said projecting spacing means extending from said internal surface of said outer casing means and providing at least one first support surface for said first baffle to abut and a second part of said projecting spacing means extending beyond said first support surface, said second part of said projecting spacing means adapted to protrude through said holes provided in said first baffle providing at least one second support surface to abut said second baffle means.

* * * * *

UNITED STATES PATENT AND TRADEMARK OFFICE

CERTIFICATE OF CORRECTION

PATENT NO. : 5,841,944

DATED : November 24, 1998

INVENTOR(S) : Christopher Peter Hutchinson; Richard Geoffrey Templer; David James Keeley It is certified that error appears in the above-indentified patent and that said Letters Patent is hereby corrected as shown below: On the title page, " References Cited "

[56] FOREIGN PATENT DOCUMENTS

"1094 10/1964 United Kingdom .....392/423 "

should be

-- 1,094,101 10/1964 United Kingdom.....392/423 --

Signed and Sealed this

Eleventh Day of May, 1999

*Attest:*

Q. TODD DICKINSON

*Attesting Officer*

*Acting Commissioner of Patents and Trademarks*